US008394560B2

(12) United States Patent
Yu et al.

(10) Patent No.: US 8,394,560 B2
(45) Date of Patent: Mar. 12, 2013

(54) IMAGING MEMBERS HAVING AN ENHANCED CHARGE BLOCKING LAYER

(75) Inventors: Robert C. U. Yu, Webster, NY (US); Yuhua Tong, Webster, NY (US); Min-Hong Fu, Webster, NY (US); Stephen T. Avery, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 295 days.

(21) Appl. No.: 12/823,963

(22) Filed: Jun. 25, 2010

(65) Prior Publication Data

US 2011/0318675 A1 Dec. 29, 2011

(51) Int. Cl.
*G03G 5/14* (2006.01)
*G03G 15/20* (2006.01)

(52) U.S. Cl. ..... 430/64; 399/116

(58) Field of Classification Search ..... 430/64; 399/116

See application file for complete search history.

(56) References Cited

U.S. PATENT DOCUMENTS 3,121,006 A 2/1964 Middleton et al.
3,820,989 A 6/1974 Rule et al.
3,837,851 A 9/1974 Shattuck et al.
3,895,944 A 7/1975 Wiedemann et al.
4,150,987 A 4/1979 Anderson et al.
4,245,021 A 1/1981 Kazami et al.
4,256,821 A 3/1981 Enomoto et al.
4,265,990 A 5/1981 Stolka et al.
4,278,746 A 7/1981 Goto et al.
4,286,033 A 8/1981 Neyhart et al.
4,291,110 A 9/1981 Lee
4,297,426 A 10/1981 Sakai et al.
4,315,982 A 2/1982 Ishikawa et al.
4,338,387 A 7/1982 Hewitt
4,338,388 A 7/1982 Sakai et al.
4,385,106 A 5/1983 Sakai
4,387,147 A 6/1983 Sakai
4,399,207 A 8/1983 Sakai et al.
4,399,208 A 8/1983 Takasu et al.
4,584,253 A 4/1986 Lin et al.
4,587,189 A 5/1986 Hor et al.
4,664,995 A 5/1987 Horgan et al.
4,988,597 A 1/1991 Spiewak et al.
5,008,169 A 4/1991 Yu et al.
5,215,839 A 6/1993 Yu
5,244,762 A 9/1993 Spiewak et al.
5,378,566 A 1/1995 Yu
5,660,961 A 8/1997 Yu
5,697,024 A 12/1997 Mishra
5,703,487 A 12/1997 Mishra
5,756,245 A 5/1998 Esteghamatian et al.
5,858,592 A * 1/1999 Nguyen et al. ..... 430/59.6
5,958,638 A 9/1999 Katayama et al.
6,008,653 A 12/1999 Popovic et al.
6,119,536 A 9/2000 Popovic et al.
6,124,514 A 9/2000 Emmrich et al.

(Continued)

*Primary Examiner* — Jonathan Jelsma
(74) *Attorney, Agent, or Firm* — Pillsbury Winthrop Shaw Pittman LLP

(57) ABSTRACT

The presently disclosed embodiments are directed to layer(s) that are useful in imaging apparatus members and components, for use in electrophotography, including digital, apparatuses. More particularly, the present embodiments provide the negatively charged electrophotographic imaging members with a novel cross-linked charge blocking undercoat layer, which is created to comprise of a binary composition of melamine and formaldehyde or a triple composition consisting of a hydroxyl functional acrylic polyol binder and a methylolation of melamine-formaldehyde, and methods for making the same. The charge blocking layer provides stabilized cyclic photo-electrical properties, enhanced mechanical adhesion bonding, and improved copy print out quality for service life extension.

20 Claims, 2 Drawing Sheets

U.S. PATENT DOCUMENTS

| | | | | |
|---|---|---|---|---|
| 6,150,824 | A | 11/2000 | Mishra et al. | |
| 6,214,514 | B1 | 4/2001 | Evans et al. | |
| 6,933,089 | B2 | 8/2005 | Horgan et al. | |
| 7,018,756 | B2 | 3/2006 | Pai et al. | |
| 7,033,714 | B2 | 4/2006 | Horgan et al. | |
| 7,045,262 | B2 * | 5/2006 | Tong et al. | 430/58.05 |
| 7,544,452 | B2 | 6/2009 | Wu et al. | |
| 2007/0049677 | A1 * | 3/2007 | Wu et al. | 524/430 |

* cited by examiner

IMAGING MEMBERS HAVING AN ENHANCED CHARGE BLOCKING LAYER

BACKGROUND

The presently disclosed embodiments relate in general to electrophotographic imaging members which are provided with a novel charge transport layer. In particular, the imaging members of present embodiments are negatively charged members comprising an improved charge blocking layer designed with a specific material composition having great capacity to prevent and/or stop hole injections into the imaging layer(s) from the conductive ground plane during the electrophotographic imaging process. The prepared imaging member, having the improved charge blocking layer, has stabilized cyclic photo-electrical properties to impact copy printout quality enhancement and extends service life when used in an electrophotographic imaging system. The present embodiments also provide a process for making and using these imaging members that further meet the service life function objectives in the field.

In electrophotographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrophotographic imaging members are well known in the art. Typically, the electrophotographic imaging members are, for example, photoreceptors) commonly utilized in electrophotographic (xerographic) processing system. Generally, these imaging members comprise at least a supporting substrate and at least one imaging layer comprising a thermoplastic polymeric matrix material. In an electrophotographic imaging member or photoreceptor, the photoconductive imaging layer may comprise only a single photoconductive layer or multiple of layers such as a combination of a charge generating layer and one or more charge transport layer(s).

Electrophotographic imaging members can have two distinctively different configurations. For example, they can comprise a flexible member, such as a flexible scroll or a belt containing a flexible substrate. Since typical flexible electrophotographic imaging members exhibit spontaneous upward imaging member curling after completion of solution coating the outermost exposed imaging layer, an anticurl back coating is therefore required to be applied to back side of the flexible substrate support to counteract/balance the curl and provide the desirable imaging member flatness. Alternatively, the electrophotographic imaging members can also be a rigid member, such as those utilizing a rigid substrate support drum. For these drum imaging members, having a thick rigid cylindrical supporting substrate bearing the imaging layer(s), there is no exhibition of the curl-up problem, and thus, there is no need for an anticurl back coating layer.

Although the scope of the present disclosure covers the preparation of all types of electrophotographic imaging members in either a rigid drum design or a flexible belt configuration, but for reasons of simplicity, the embodiments and discussion following hereinafter will be focused solely on and represented by electrophotographic imaging members in the flexible belt configuration.

Electrophotographic flexible belt imaging members may include a photoconductive layer including a single layer or composite layers. The flexible belt electrophotographic imaging members may be seamless or seamed belts. Seamed belts are usually formed by cutting a rectangular sheet from a web, overlapping opposite ends, and welding the overlapped ends together to form a welded seam. Typical electrophotographic imaging member belts include a charge transport layer and a charge generating layer on one side of a supporting substrate layer and an anticurl back coating coated onto the opposite side of the substrate layer. By comparison, a typical electrographic imaging member belt does, however, have a more simple material structure; it includes a dielectric imaging layer on one side of a supporting substrate and an anti-curl back coating on the opposite side of the substrate to render flatness. Since typical negatively-charged flexible electrophotographic imaging members exhibit undesirable upward imaging member curling after completion of coating the top outermost charge transport layer, an anticurl back coating, applied to the backside, is required to balance the curl. Thus, the application of anticurl back coating is necessary to provide the appropriate imaging member with desirable flatness.

One type of composite photoconductive layer used in xerography is illustrated in U.S. Pat. No. 4,265,990 which describes a negatively-charged photosensitive member having at least two electrically operative layers. One layer comprises a photoconductive layer which is capable of photogenerating holes and injecting the photogenerated holes into a contiguous charge transport layer.

Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer (CGL) is sandwiched between the outermost exposed charge transport layer (CTL) and the electrically conducting layer, the outer surface of the charge transport layer is charged negatively and the conductive layer is charged positively. The CGL then should be capable of generating electron hole pair when exposed image wise and inject only the holes through the charge transport layer. In the alternate case when the charge transport layer is sandwiched between the CGL and the conductive layer, the outer surface of Gen layer is charged positively while conductive layer is charged negatively and the holes are injected through from the CGL to the charge transport layer. The CTL should be able to transport the holes with as little trapping of charge as possible. In a typical flexible imaging member web like photoreceptor, the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a CTL and a conductive ground strip layer adjacent to one edge of the imaging layers, and an optional overcoat layer adjacent to another edge of the imaging layers. Such a photoreceptor usually further comprises an anticurl back coating layer on the side of the substrate opposite the side carrying the conductive layer, support layer, blocking layer, adhesive layer, CGL, CTL and other layers.

Typical negatively-charged imaging member belts, such as flexible photoreceptor belt designs, are made of multiple layers comprising a flexible supporting substrate, a conductive ground plane, a charge blocking layer, an optional adhesive layer, a CGL, and a CTL. The CTL is usually the last layer to be coated to become the outermost exposed layer and is applied by solution coating then followed by drying the wet applied coating at elevated temperatures of about 115° C., and finally cooling it down to ambient room temperature of about 25° C. When a production web stock of several thousand feet of coated multilayered photoreceptor material is obtained after finishing the CTL coating through drying/cooling process, upward curling of the multilayered photoreceptor is observed.

This upward curling is a consequence of thermal contraction mismatch between the CTL and the substrate support. Since the CTL in a typical photoreceptor device has a coefficient of thermal contraction approximately 3.7 times greater than that of the flexible substrate support, the CTL exhibits a larger dimensional shrinkage than that of the substrate support as the imaging member web stock (after through elevated temperature heating/drying process) as it cools down to ambient room temperature. This dimensional contraction mismatch results in tension strain built-up in the CTL, at this instant, is pulling the imaging member web stock upward to exhibit curling. If unrestrained at this point, the imaging member web stock (for example, one comprising a 24 micrometer polycarbonate-diamine imaging layer and a 3.5 mil polyethylene terephthalate substrate) will spontaneously curl upwardly into a 1.5-inch roll. To offset the curling, an anticurl back coating is applied to the backside of the flexible substrate support, opposite to the side having the charge transport layer, and render the imaging member web stock with desired flatness.

Conventional photoreceptors are disclosed in the following patents, a number of which describe the presence of light scattering particles in the undercoat layers: U.S. Pat. No. 5,660,961; U.S. Pat. No. 5,215,839; and U.S. Pat. No. 5,958,638. The term "photoreceptor" or "photoconductor" is generally used interchangeably with the terms "electrophotographic imaging member." The terms "charge transport molecule" are generally used interchangeably with the terms "hole transport molecule." And also, the term "charge blocking layer" is generally used interchangeably with the term "hole blocking layer".

Relevant prior arts to the present disclosure are collectively summarized for reference and presented in the following.

In U.S. Pat. No. 7,544,452, it discloses an electrophotographic imaging member comprising a thick undercoat layer further comprising specific binders. The binders contain metal oxide nanoparticles and a co-resin of phenolic resin and aminoplast resin.

In U.S. Pat. No. 4,584,253, it discloses an electrophotographic imaging member comprising a charge generation layer, a contiguous charge transport layer comprising an aromatic amine or hydrazone charge transport molecules in a continuous polymeric binder phase, and a hydroxyl alkyl cellulosic hole trapping material located on the same side of the charge transport layer as the charge generation layer. The hydroxyl alkyl cellulosic hole trapping material being used is free of electron withdrawing groups. A process for using this electrophotographic imaging member is also disclosed.

In U.S. Pat. No. 5,008,169, it discloses an electrophotographic imaging member comprised of a supporting substrate, a ground strip layer, a hole blocking-adhesive layer comprised of a polyphosphazene, including polyorganophosphazeness, a photogenerating layer, and a hole transport layer.

In U.S. Pat. No. 5,378,566, it discloses a structurally simplified electrophotographic imaging member including a substrate, a hole blocking/adhesive layer, a charge generation layer, and a charge transport layer, the hole blocking/adhesive layer including a film forming binder having dispersed therein a particulate reaction product of metal oxide particles and a hydrolyzed reactant selected from the group consisting of a nitrogen containing organo silane, an organotitanate and an organozirconate and mixtures thereof. In embodiments, the imaging member is free of any distinctive adhesive layer in contiguous contact with the hole blocking/adhesive layer. This imaging member may be utilized in an electrophotographic imaging process In U.S. Pat. No. 5,660,961, it discloses an electrophotographic imaging member including a substrate, a charge blocking layer, an optional adhesive layer, a charge generating layer, and charge transport layer, the blocking layer comprising solid finely divided light scattering inorganic particles having an average particle size of from about 0.3 micrometer to about 0.7 micrometer selected from the group consisting of amorphous silica, mineral particles an mixtures thereof, dispersed in a matrix material comprising the chemical reaction product of (a) a film-forming polymer selected from the group consisting of hydroxyl alkyl cellulose, hydroxyl alkyl methacrylate polymer, hydroxyl alkyl methacrylate copolymer, and mixtures thereof and (b) an organosilane.

Thus, electrophotographic imaging members (comprising a supporting substrate, having a conductive surface on one side, directly coated over a charge blocking layer with subsequent photo-electrically active layers and an anticurl back coating layer coated on the other side of the supporting substrate) used in the negative charging system do still exhibit deficiencies which are undesirable in advanced automatic, cyclic electrophotographic imaging copiers, duplicators, and printers. While the above mentioned electrophotographic imaging members may be suitable or limited for their intended purposes, further improvement on these imaging members are needed. For example, there continues to be a need for improvements in such systems, particularly for an imaging member belt that includes an active charge blocking layer that is easy to apply by a solution coating process and with effective hole blocking property to enhance image printout quality free of spot defects in the output copies.

SUMMARY

In embodiments, there is provided a negatively charged electrophotographic imaging member, comprising: a substrate; a charge blocking undercoat layer disposed on the substrate, wherein the charge blocking undercoat layer is cross-linked and formed from a coating solution comprising a melamine, a formaldehyde, a catalyst, and a solvent; and at least one imaging layer formed on the cross-linked charge blocking undercoat layer, wherein the cross-linked melamine-formaldehyde is a three dimensional cross-linked network of melamine-formaldehyde formed by the following reactions:

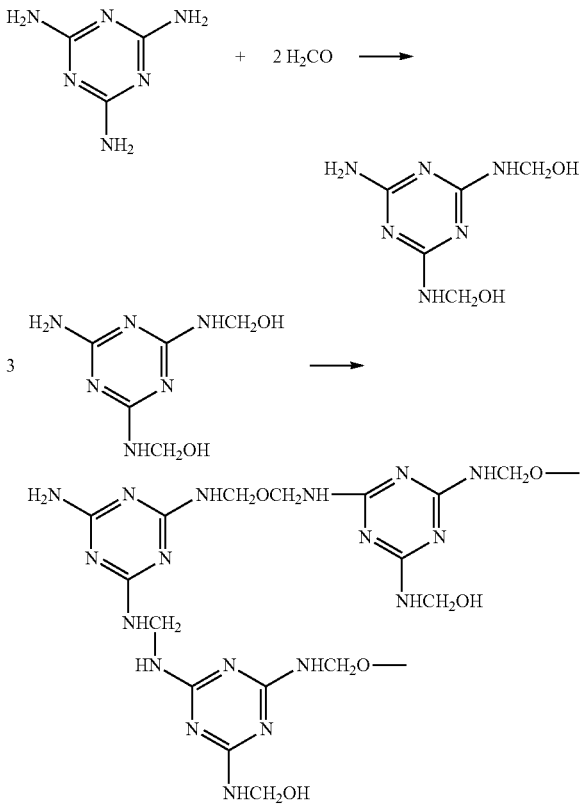

Another embodiment provides a negatively charged electrophotographic imaging member, comprising: a substrate comprising a conductive layer; a charge blocking undercoat layer disposed on the conductive layer bearing substrate, wherein the charge blocking undercoat layer is formed from a coating solution further comprising a polyol binder, a melamine-formaldehyde (methylolated melamine) cross-linking agent, a catalyst, and a solvent; and at least one imaging layer formed on the charge blocking undercoat layer.

In yet another embodiment, there is a negatively charged electrophotographic imaging member, comprising: a substrate; a charge blocking undercoat layer disposed on the substrate, wherein the charge blocking undercoat layer is formed from a coating solution further comprising a hydroxyl functional acrylic polyol binder, a methylolated melamine, a catalyst, and a solvent; and at least one imaging layer formed on the charge blocking undercoat layer, wherein the charge blocking undercoat layer is a three dimensional cross-linked network formed from the reaction between the methylolated melamine and the hydroxyl functional acrylic polymer binder to obtain a cross-linked polyacrylate/melamine-formaldehyde charge blocking undercoat layer.

In yet a further embodiment, there is a provided an image forming apparatus for forming images on a recording medium comprising: a) a negatively charged electrophotographic imaging member having a charge retentive-surface to receive an electrostatic latent image thereon, wherein the electrophotographic imaging member comprises: a flexible substrate, a cross-linked charge blocking undercoat layer disposed on the substrate, wherein the cross-linked charge blocking undercoat layer is formed from a coating solution comprising a melamine, a formaldehyde, a catalyst, and a solvent, or alternatively an acrylic polyol binder, a methylolated amine, a catalyst, and a solvent, and at least one imaging layer formed on the cross-linked charge blocking undercoat layer; b) a development component adjacent to the charge-retentive surface for applying a developer material to the charge-retentive surface to develop the electrostatic latent image to form a developed image on the charge-retentive surface; c) a transfer component adjacent to the charge-retentive surface for transferring the developed image from the charge-retentive surface to a copy substrate; and d) a fusing component adjacent to the copy substrate for fusing the developed image to the copy substrate.

BRIEF DESCRIPTION OF THE DRAWINGS

For a better understanding of the present disclosure, reference may be made to the accompanying figures.

DETAILED DESCRIPTION OF DRAWING

In the following description, reference is made to the accompanying drawings, which form a part hereof and which illustrate several embodiments of the present disclosure. It is understood that other embodiments may be utilized and structural and operational changes may be made without departure from the scope of the present disclosure.

Figure 1:
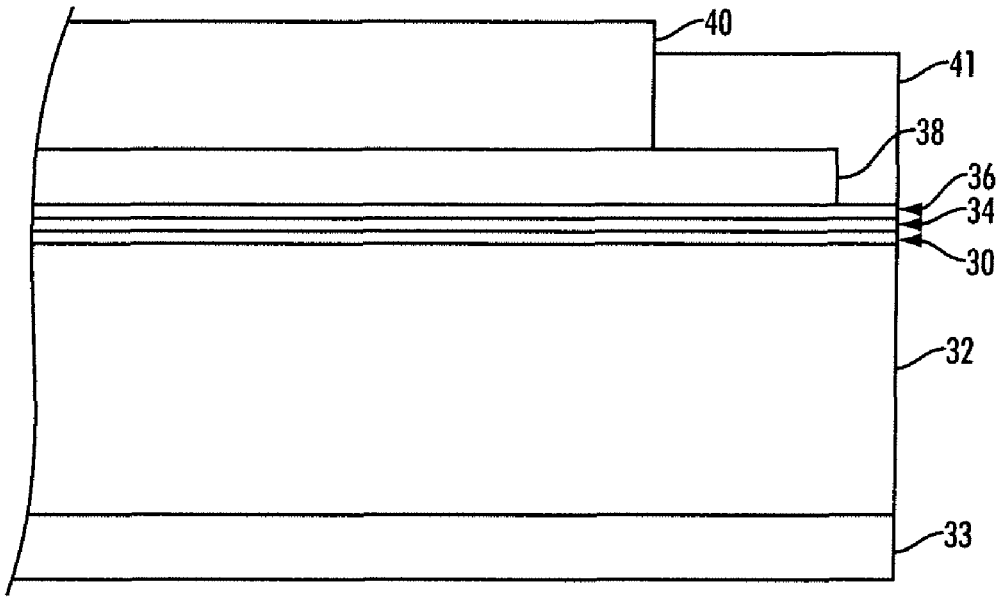
FIG. 1 PRIOR ART
FIG. 1 is a schematic cross-sectional view of a conventional prior art negatively charged flexible multilayered electrophotographic imaging member.

Illustrated in FIG. 1 is the structure of a negatively charged flexible multilayered electrophotographic imaging member of the prior art, detailing all the photo-electrically active layers and their respective material compositions.

The flexible substrate 32 is provided with a surface conductive grounding layer 30. A charge blocking layer 34 of this disclosure is applied onto the conductive ground layer and coated over with an adhesive layer 36. The CGL 38 is then disposed above the adhesive layer 30 and a CTL 40 is disposed directly over the CGL. A ground strip layer 41 applied to one edge of the imaging member operatively connects the CGL 38 and the CTL 40 through the charge blocking layer 34 to promote electrical continuity with the conductive layer 30. An anti-curl back layer 33 is applied to the other side of the substrate 32 opposite from the electrically active layers to render the imaging member flatness control and complete the imaging member structure.

The Substrate

The photoreceptor support substrate 32 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The substrate 32 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate available as KALEDEX 2000 available from BSF Specialty Films, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate 32 the substrate may have a number of many different configurations, such as, for example, a plate, a drum, a scroll, an endless flexible belt, and the like. In one embodiment, the substrate is in the form of a seamed flexible belt.

The thickness of the substrate 32 depends on numerous factors, including flexibility, mechanical performance, and economic considerations. The thickness of the support substrate 32 may range from about 2 mils to about 10 mils. In embodiments of flexible photoreceptor belt preparation, the thickness of substrate 32 is from about 3 mils to about 8 mils for optimum flexibility and to effect minimum induced photoreceptor surface bending stress when a photoreceptor belt is cycled around small diameter rollers in a machine belt support module, for example, 19 millimeter diameter rollers.

An exemplary substrate support 32 is not soluble in any of the solvents used in each coating layer solution, has reasonable optical transparency, and is thermally stable up to a high temperature of about 150° C. to allow production imaging member solution coating application and elevated temperature coating layer(s) drying process. A typical substrate support 32 used for imaging member fabrication has a thermal contraction coefficient ranging from about $1\times10^{-5}$/° C. to about $3\times10^{-5}$/° C. and a Young's Modulus of from about $5\times10^{-5}$ psi ($3.5\times10^{-4}$ Kg/cm$^2$) to about $7\times10^{-5}$ psi ($4.9\times10^{-4}$ Kg/cm$^2$).

The Conductive Layer

The conductive ground plane layer 30 may vary in thickness depending on the optical transparency and flexibility desired for the electrophotographic imaging member. When a photoreceptor flexible belt is desired, the thickness of the conductive layer 30 on the support substrate 32, for example, a titanium and/or zirconium conductive layer produced by a sputtered deposition process, typically ranges from about 2 nanometers to about 75 nanometers to enable adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 30 may be an electrically conductive metal layer which may be formed, for example, on the substrate by any suitable coating technique, such as a vacuum depositing or sputtering technique. Typical metals suitable for use as conductive layer 30 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface thereof can perform the function of an electrically conductive layer and a separate electrical conductive layer may be omitted. Other examples of conductive layers may be combinations of materials such as conductive indium tin oxide as a transparent layer for light having a wavelength from about 4000 Angstroms to about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 30 comprising an electrically conductive material, such as titanium or titanium/zirconium, coating over the substrate layer 32.

The Charge Blocking Layer

A charge (hole) blocking layer 34 may then be applied over to the conductive layer 30 of the substrate 32 or to, where present. Any suitable positive charge (hole) blocking layer capable of forming an effective barrier to the injection of holes from the adjacent conductive layer 30 into the photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl)methyl diethoxysilane which has the formula $[H_2N(CH_2)_4]CH_3Si(OC_{H3})_2$, and (gamma-aminopropyl)methyl diethoxysilane, which has the formula $[H_2N(CH_2)_3]CH_{33}Si(OCH_3)_2$, and combinations thereof, as disclosed, for example, in U.S. Pat. Nos. 4,338,387; 4,286,033; and 4,291,110, incorporated herein by reference in their entireties. One hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly(2-hydroxyethyl methacrylate) blended with the parent polymer poly(2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. patents are incorporated herein by reference in their entireties Although the blocking layers disclosed in the prior art do offer charge blocking capability, these disclosed blocking layers still suffer from inadequacies. For example, the prior art blocking layers suffer from poor adhesion that leads to premature imaging member layer delamination, or inadequate charge blocking power to cause high dark potential voltage decay. The prior art blocking layers also suffer from non-uniform coating layer thickness that results in copy printout quality degradation due to appearance of reticulation print defects in the output paper. In view of these problems, there is a need to find an alternative blocking layer that could provide the imaging member with robust photo-electrical/mechanical functions and copy quality enhancement, free of the identified problems to achieve effective service life extension in the field.

In the present embodiments, there is provided a material formulation for a novel charge blocking layer that is easy to apply by solution coating process for impacting copy quality printout as well as extending the functional life of a negatively charged flexible multilayered electrophotographic imaging member under the normal machine functioning conditions in the field.

The embodiments of the present disclosure as described hereinafter provide improvement upon the photo-electrical/mechanical functions of the prior art flexible multilayered imaging member used in negatively charged electrophotographic imaging machine, as shown in FIG. 1, through replacement of the charge blocking layer 34 with an alternative layer designed to contain a cross-linkable melamine formaldehyde. In the present embodiments, the selection of melamine-formaldehyde layer as a charge blocking undercoat layer for direct deposition over the conductive layer 30 is to achieve greater hole (positive charges) injection blocking impact and effect the layer's adhesion enhancement. This is based on the facts that: (1) melamine-formaldehyde is known to be, by itself, an effective adhesion layer to ensure strong adhesion bonding strength without layer delamination; and (2) melamine-formaldehyde is inherently a charge (hole) trapping material because the six nitrogen atoms, with each carrying a lone pair electrons, present in a melamine molecule do provide electron donating effect to impart great capacity for maximizing the charge blocking power and stop holes injection from the positively grounded conductive layer 30 below as the top surface of the imaging member is negatively charged during electrophotographic imaging process. The creation of melamine-formaldehyde charge blocking undercoat layer 34 of the present disclosure for imaging member application can be carried out to produce two material composition variances as described in the following paragraphs.

In one exemplary embodiment of the present disclosure, the formulation of the disclosed melamine-formaldehyde charge blocking undercoat layer 34, having binary material compositions, is created by first reacting the melamine with formaldehyde to give methylolated melamines which are then subsequently cross-linked, among themselves, into a three-dimensional cross-linked network by condensation reaction activated at an elevated temperature or an elevated temperature and a catalyst. The term "methylolated melamine" means that the melamine is already reacted or combined with the formaldehyde. In embodiments, the elevated temperature is in a range of from about 120 to about 130° C. The mole ratio of melamine to formaldehyde is from about 1:2 to about 1:6. The chemical reactions leading to the formation of the melamine-formaldehyde charge undercoat layer are represented by the following two reaction steps:

(I) The Methylolation Reaction of Melamine and Formaldehyde

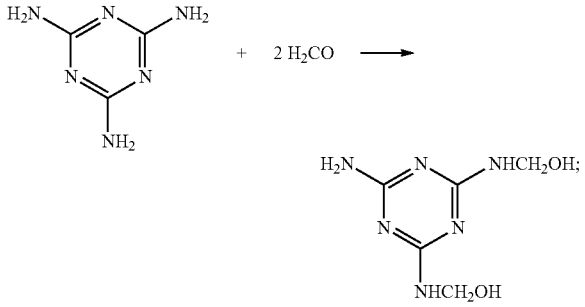

and (II) The Condensation/Cross-Linking Reaction of Methylolated Melamine to Form Three Dimensional Network

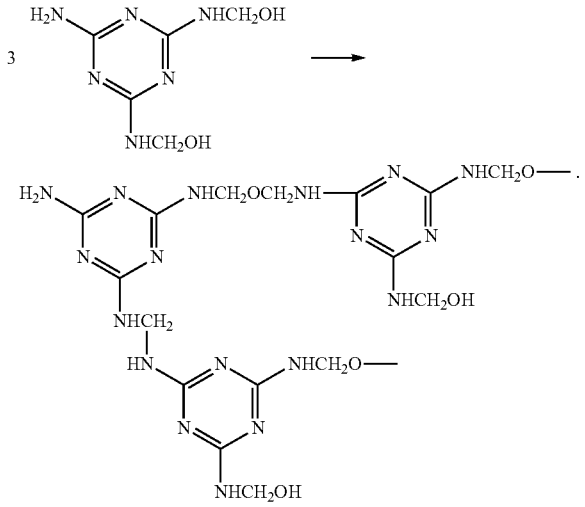

In a second exemplary embodiment, the formulation of another melamine-formaldehyde charge blocking undercoat layer in the imaging member is alternatively modified and re-designed by the inclusion of a film forming hydroxyl functional acrylic polyol binder to give a cross-linked polyacrylate/melamine-formaldehyde layer variance consisting of a triple material composition of melamine, formaldehyde, and an acrylic polyol binder. The selected hydroxyl functional acrylic polyol binder (available from BASF) is a polyhydroxyalkyl acrylate which has a molecular weight of about 100,000 and it does contain all the hydroxyl groups at the polymer side chains readily for effective cross-linking reaction in the presence of melamine-formaldehyde. In essence, the re-formulation process of this melamine-formaldehyde charge blocking undercoat layer variance is achieved by addition of the hydroxyl functional acrylic polyol to a methylolated melamine resin (Cymel 303LF, commercially available from Cytec) and both then dissolve, along with a catalyst, in an alcohol solvent to form a coating solution. After coating solution application over the conductive layer bearing substrate support and under the elevated temperature drying condition, the methylolated melamine-formaldehyde, functioning as cross-linker, reacts with the hydroxyl side groups of the acrylic polyol molecules to form the modified cross-linked charge blocking undercoat layer variance 34 of this disclosure. Therefore, the resulting cross-linked charge blocking undercoat layer 34, thus obtained as a design variance of polyacrylate/melamine-formaldehyde undercoat layer 34, has a triple material composition comprising the melamine-formaldehyde resin and the hydroxyl functional acrylic polymer (obtained as Joncryl 587 from BASF) in an amount of from about 30 to about 50 weight percent of the hydroxyl functional acrylic polyol, based on the total weight of the disclosed cross-linked polyacrylate/melamine-formaldehyde undercoat layer 34.

The polyhydroxyalkyl acrylate or hydroxyl functional acrylic polyol, suitable for the creation of a triple composition cross-linked polyacrylate/melamine-formaldehyde undercoat layer 34 of this disclosure, may be selected from the groups consisting of polyhydroxymethyl acrylate, polyhydroxyethyl acrylate, polyhydroxyproyl acrylate, polyhydroxybutyl acrylate, polyhydroxypentyl acrylate, polyhydroxyhexyl acrylate, and mixtures thereof.

The novel melamine-formaldehyde charge blocking undercoat layer 34 thus prepared, according to each description above, is a substantially continuous and uniform melamine-formaldehyde cross-linked layer which has a thickness of from about 50 to about 2,000 angstroms or from about 100 to about 1,500 angstroms, or from about 200 to about 1,000 angstroms, that gives optimum charge blocking function and photo-electrical performance. The melamine-formaldehyde charge blocking undercoat layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the charge blocking undercoat layer may be applied in the form of a dilute solution, with the solvent being removed after deposition of the coating by conventional techniques, such as, by vacuum, heating, and the like. Typical solvent(s) used for melamine-formaldehyde charge blocking undercoat layer solution preparation may include 1-methoxy-2-propanol, methyl n-amy ketone, methyl ethyl ketone, n-butyl Acetate, xylene, toluene, glycol ether acetates, and mixture thereof. Generally, a weight ratio of the melamine-formaldehyde charge blocking undercoat layer solid to solvent in a typical coating solution is from about 0.2:100 to about 2:100, and is satisfactory for use by extrusion coating. Typical catalyst(s) used to activate the cross-linking reaction are selected from the group consisting of dibutyltin dilaurate, zinc octoate, p-toluene sulfonic acid, and mixtures thereof.

The Adhesive Interface Layer

An optional separate adhesive interface layer 36 may be provided. In the embodiment illustrated in FIG. 1, an interface layer 36 is situated intermediate the blocking layer 34 and the charge generator layer 38. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Haas, polyvinyl butyral, and the like. The adhesive interface layer 36 may be applied directly to the hole blocking layer 34. Thus, the adhesive interface layer 36 in embodiments is in direct contiguous contact with both the underlying hole blocking layer 34 and the overlying charge generator layer 38 to enhance adhesion bonding to provide linkage. In yet other embodiments, the adhesive interface layer 36 is entirely omitted.

Any suitable solvent or solvent mixtures may be employed to form a coating solution of the polyester for the adhesive interface layer 36. Typical solvents include tetrahydrofuran, toluene, monochlorobenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 36 may have a thickness of from about 0.01 micrometers to about 900 micrometers after drying. In embodiments, the dried thickness is from about 0.03 micrometers to about 1 micrometer.

The Charge Generating Layer

The photogenerating layer, CGL 38 may thereafter be applied to the adhesive layer 36. Any suitable charge generating binder layer 38 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength from about 400 to about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the CGL 38, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a $M_W$=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The CGL 38 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Charge Transport Layer

The CTL 40 is thereafter applied over the charge generating layer 38 and may include any suitable transparent organic polymer or non-polymeric material capable of supporting the injection of photogenerated holes or electrons from the charge generating layer 38 and capable of allowing the transport of these holes/electrons through the CTL to selectively discharge the surface charge on the imaging member surface. In one embodiment, the CTL 40 not only serves to transport holes, but also protects the charge generating layer 38 from abrasion or chemical attack and may therefore extend the service life of the imaging member. The CTL 40 can be a substantially non-photoconductive material, but one which supports the injection of photogenerated holes from the charge generation layer 18. The layer 40 is normally transparent in a wavelength region in which the electrophotographic imaging member is to be used when exposure is effected therethrough to ensure that most of the incident radiation is utilized by the underlying charge generating layer 38. The CTL should exhibit excellent optical transparency with negligible light absorption and neither charge generation nor discharge if any, when exposed to a wavelength of light useful in xerography, e.g., 400 to 900 nanometers. In the case when the photoreceptor is prepared with the use of a transparent substrate 32 and also a transparent conductive layer 30, image wise exposure or erase may be accomplished through the substrate 32 with all light passing through the back side of the substrate. In this case, the materials of the layer 40 need not transmit light in the wavelength region of use if the charge generating layer 38 is sandwiched between the substrate and the CTL 40. The CTL 40 in conjunction with the charge generating layer 38 is an insulator to the extent that an electrostatic charge placed on the CTL is not conducted in the absence of illumination. The CTL 40 should trap minimal charges as the charge pass through it during the printing process.

The CTL 40 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 38 and capable of allowing the transport of these holes through the CTL 40 in order to discharge the surface charge on the CTL. The charge transport component typically comprises small molecules of an organic compound which cooperate to transport charge between molecules and ultimately to the surface of the CTL.

Any suitable inactive resin binder soluble in methylene chloride, chlorobenzene, or other suitable solvent may be employed in the CTL. Exemplary binders include polyesters, polyvinyl butyrals, polycarbonates, polystyrene, polyvinyl formals, and combinations thereof. The polymer binder used for the CTLs may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly(4,4'-isopropylidene diphenyl carbonate), poly(4,4'-diphenyl-1,1'-cyclohexane carbonate), and combinations thereof. The molecular weight of the binder can be for example, from about 20,000 to about 1,500,000. One exemplary binder of this type is a FPC0170 binder, which is available from Mitsubishi Gas and Chemicals Corporation and comprises poly(4,4'-isopropylidene diphenyl) carbonate having a weight average molecular weight of about 120,000.

Exemplary charge transport components include aromatic polyamines, such as aryl diamines and aryl triamines. Exemplary aromatic diamines include N,N'-diphenyl-N,N'-bis(alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in CTL 40 may be, for example, at least about 5 weight percent and may comprise up to about 60 weight percent. The concentration or composition of the charge transport component may vary through layer 40, as disclosed, for example, in U.S. Pat. Nos. 7,033,714; 6,933,089; and 7,018,756, the disclosures of which are incorporated herein by reference in their entireties.

In one exemplary embodiment, layer 40 comprises an average of about 10-60 weight percent N,N'-diphenyl-N,N'-bis(3-methylphenyl)-1,1'-biphenyl-4,4'-diamine, such as from about 30-50 weight percent N,N'-diphenyl-N,N'-bis(3-methylphenyl)-1,1'-biphenyl-4,4'-diamine.

The CTL 40 is an insulator to the extent that the electrostatic charge placed on the CTL is not conducted in the absence of illumination at a rate sufficient to prevent formation and retention of an electrostatic latent image thereon. In general, the ratio of the thickness of the CTL 40 to the charge generator layer 38 is maintained from about 2:1 to about 200:1 and in some instances as great as about 400:1.

Additional aspects relate to the inclusion in the CTL 40 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. Pat. No. 7,018,756, incorporated by reference.

In one specific embodiment, the CTL 40 is a solid solution including a charge transport component, such as N,N'-diphenyl-N,N'-bis(3-methylphenyl)-1,1'-biphenyl-4,4'-diamine, molecularly dissolved in a polycarbonate binder, the binder that is frequently being used is either a bisphenol A polycarbonate of poly(4,4'-isopropylidene diphenyl carbonate) or a bisphenol Z polycarbonate of poly(4,4'-diphenyl-1,1'-cyclohexane carbonate).

Bisphenol A is a chemical building block primarily used to make polycarbonate plastic and epoxy resins. The film forming bisphenol A polycarbonate, having a weight average molecular weight of from about 20,000 to about 130,000 is typically used as the CTL binder; it has a molecular structure formula shown below:

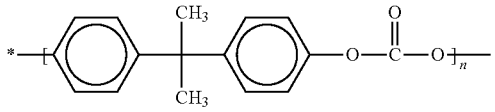

where n indicates the degree of polymerization. Alternatively, the bisphenol Z polycarbonate of poly(4,4'-diphenyl-1,1'-cyclohexane carbonate) may also be used to for binder the CTL formulation. The molecular structure of poly(4,4'-diphenyl-1,1'-cyclohexane carbonate), having a weight average molecular weight of about from about 20,000 to about 200,000, is given in the formula below:

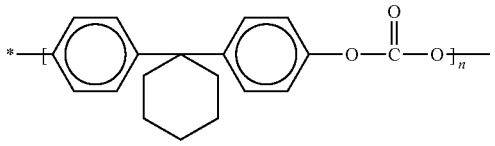

where n indicates the degree of polymerization.

The conventional CTL 40 may have a Young's Modulus in the range of from about $2.5\times10^{-5}$ psi ($1.7\times10^{-4}$ Kg/cm$^2$) to about $4.5\times10^{-5}$ psi ($3.2\times10^{-4}$ Kg/cm$^2$) and a thermal contraction coefficient of from about $6\times10^{-5}$/° C. to about $8\times10^{-5}$/° C.

The thickness of the CTL 40 can be from about 5 micrometers to about 200 micrometers or from about 15 micrometers to about 40 micrometers. The CTL may comprise dual layers or multiple layers with different concentration of charge transporting components.

The Ground Strip Layer

Other layers such as conventional ground strip layer 41 is conveniently applied by co-coating process along with the application of CTL and adjacent to one edge of the imaging member. A typical ground strip layer 41 does include, for example, conductive particles dispersed in a film forming binder may be applied to one edge of the imaging member to promote electrical continuity with the conductive layer 30 through the hole blocking layer 34. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer may have a thickness from about 7 micrometers to about 42 micrometers, for example, from about 14 micrometers to about 23 micrometers.

The Anticurl Back Coating

Since the CTL 40 can have a substantial thermal contraction mismatch compared to that of the substrate support 32, the prepared flexible electrophotographic imaging member may exhibit spontaneous upward curling due to the result of larger dimensional contraction in the CTL than the substrate support 32, as the imaging member cools down from its Tg to room ambient temperature after the heating/drying processes of the applied wet CTL coating. An anti-curl back coating 33 can be applied to the back side of the substrate support 32 (which is the side opposite the side bearing the electrically active coating layers) in order to render the prepared imaging member with desired flatness.

Generally, anticurl back coating 33 comprises a polymer and an adhesion promoter dissolved in a solvent and coated on the reverse side of the active photoreceptor. The anticurl back coating must adhere well to the substrate 32, for example polyethylenenaphthalate (KADELEX) substrate, of the imaging member, for the entire duration of the functional life of the imaging member belt, while being subjected to xerographic cycling over rollers and backer bars within the copier or printer.

In a conventional anticurl back coating, film forming bisphenol A polycarbonate or bisphenol Z polycarbonate, same as the binder polymer used in the CTL 40, is also used for anticurl back coating preparation. To promote adhesion bonding to the substrate support 33, an adhesion promoter of copolyester is included in its material matrix to effect the anticurl back coating adhesion strength to the substrate support. Satisfactory adhesion promoter content is from about 0.2 percent to about 20 percent or from about 2 percent to about 10 percent by weight, based on the total weight of the anticurl back coating The adhesion promoter may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. A solvent such as methylene chloride may be used in embodiments. The anticurl back coating has a thickness of from about 5 micrometers to about 50 micrometers, or from about 10 micrometers to about 20 micrometers, in further embodiments. A generic or conventional anticurl back coating formulation is a 92:8 ratio of polymer to adhesive dissolved at 9 percent by weight in a solvent. Specifically, the formulation may be 92:8 ratio of polycarbonate to VITEL PE2200 adhesive. The polycarbonate and adhesive promoter may both be dissolved at 9 percent by weight in a solvent of methylene chloride to give the anticurl back coating solution.

The Overcoat Layer

Figure 2:
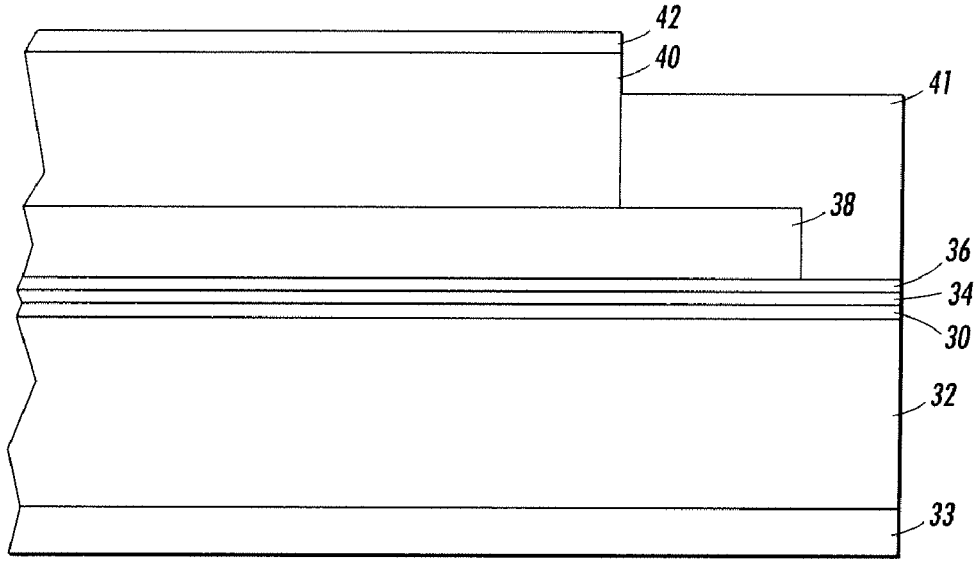
FIG. 2 is a schematic cross-sectional view of the negatively charged flexible multilayered electrophotographic imaging member of the embodiment shown in FIG. 1, except that an overcoat layer is added onto the CTL to provide protection and prepared according to the embodiments of the present disclosure.

The imaging member as described may also optionally have the inclusion/addition of a physically/mechanically robust overcoat 42, over the CTL 40 of the imaging member, as the illustration shown in FIG. 2, to provide surface protection against abrasion, scratch, wear, surface filming development, and attack from chemical contaminants. Since the outermost exposed CTL 40 is repeatedly subjected to mechanical interactions and is also highly susceptible to chemical vapor exposure, the CTL suffers from material degradation under a normal machine service environment. This is a result of constant mechanical interaction against cleaning blade, cleaning brush, dirt debris, carrier beads from developer, loose $CaCO_3$ particles from paper, and chemical attack from corona effluent or volatile solvent species exposure. Moreover, the CTL of typical imaging member belts is also found to be prone to develop surface filming that exacerbates the early onset of print quality failure and prevents the imaging member belt from reaching its service life target. Therefore, the added protective overcoat layer 42 serves to suppress or eliminate the issues.

The flexible multilayered electrophotographic imaging member of an extended embodiment of the present disclosure is shown in FIG. 2. Although all the photoelectrically active layers 30, 32, 33, 36, 38, 40, 41, and the melamine-formaldehyde charge blocking layer 34, in this imaging member are prepared and maintained to comprise the very exact same compositions and dimensions as those described in FIG. 1, there is additionally included an optional overcoat layer 42 added onto the CTL 40 to render protection against abrasion/wear and chemical contaminant attack.

Figure 3:
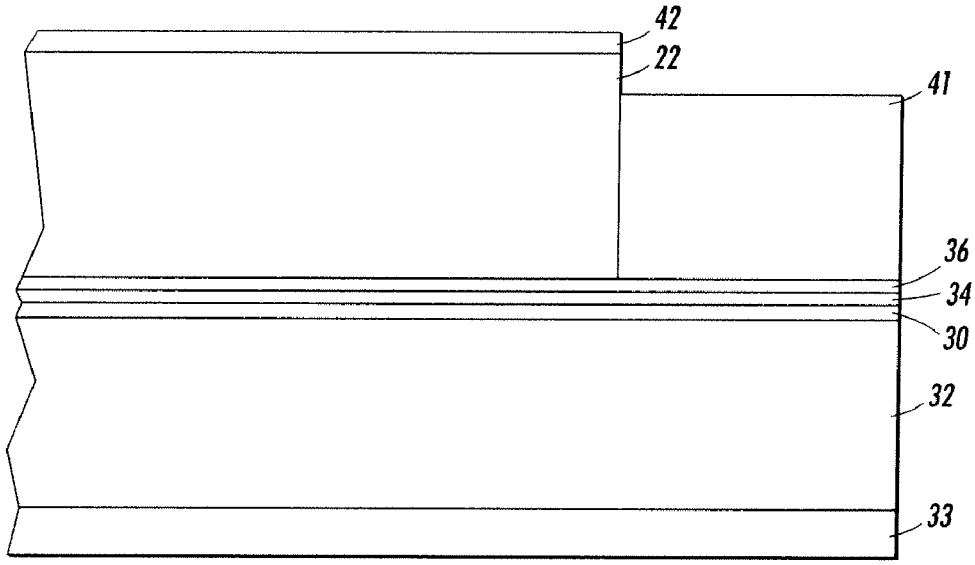
FIG. 3 is a schematic cross-sectional view of another negatively charged flexible multilayered electrophotographic imaging member modified from FIG. 2 to comprise a simplified single CTL/CGL layer and a charge blocking layer prepared according to the embodiments of the present disclosure.

In an alternative embodiment, the overcoated imaging member of FIG. 2 is further modified to give a structurally simplified imaging member in which a single imaging layer formulated to have dual charge generating and charge transporting capacities is used to replace both the CGL and the CTL. The simplified structure flexible multilayered electrophotographic imaging member containing the melamine-formaldehyde charge blocking layer of this disclosure is shown in FIG. 3.

The flexible imaging members, which are prepared to contain a novel melamine-formaldehyde charge blocking layer, have enhanced photo-electrical and mechanical functions as well as photoelectrical integrity as compared to the control imaging member. For example, the embodiments have charge acceptance ($V_0$) in a range of from about 750 to about 850 volts, sensitivity (S) from about 250 to about 450 volts/ergs/$cm^2$, residual potential ($V_r$) less than about 100 volts, an a depletion potential (Vdepl) of less than 200 volts, and the value of dark decay per second after charging (A) of less than 300 volts.

The multilayered, flexible multilayered electrophotographic imaging member web stocks fabricated in accordance with the embodiments described herein may be cut into rectangular sheets. Each cut sheet is then brought overlapped at ends thereof and joined by any suitable means, such as ultrasonic welding, gluing, taping, stapling, or pressure and heat fusing to form a continuous imaging member seamed belt, sleeve, or cylinder.

The flexible imaging member belt thus prepared may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The flexible electrophotographic imaging member can be evaluated by printing in a marking engine into which a photoreceptor belt formed according to the exemplary embodiments has been installed. For the intrinsic electrical properties, it can also be investigated by mounting imaging member sample(s) on a conventional electrical drum scanner. Alternatively, the impact on charge deficient spots development propensity or suppression can also be evaluated using electrical techniques, such as those disclosed in U.S. Pat. Nos. 5,703,487; 5,697,024; 6,008,653; 6,119,536; 6,150,824 and 5,703,487, which are incorporated herein in their entireties by reference.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Control Example

Conventional Imaging Member Preparation

A conventional prior art flexible electrophotographic imaging member web as that shown in FIG. 1 was prepared by providing a 0.02 micrometer thick titanium/zirconium (Ti/Zr) layer coated substrate of a biaxially oriented polyethylene naphthalate substrate (PEN, available as KADALEX from DuPont Teijin Films.) having a thickness of 3½ mils.

The metalized KADALEX substrate was extrusion-coated with a charge blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a cross-linked silane blocking layer. The resulting blocking layer had an average dry thickness of 0.04 micrometer as measured with an ellipsometer.

An adhesive interface layer (IFL) was then applied by extrusion-coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface (IFL) layer was thereafter coated over with a CGL. The charge generating layer dispersion was prepared by adding 0.45 gram of IUPILON 200, a polycarbonate of poly(4,4'-diphenyl)-1,1'-cyclohexane carbonate (PCZ 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This CGL comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web was simultaneously coated over with a charge transport layer (CTL) and a ground strip layer by co-extrusion of the coating materials. The CTL was prepared by introducing into an amber glass bottle in a weight ratio of 1:1 (or 50 weight percent of each) of a bisphenol A polycarbonate thermoplastic (FPC 0170, having a molecular weight of about 120,000 and commercially available from Mitsubishi Chemicals) and a charge transport compound of N,N'-diphenyl-N,N'-bis(3-methylphenyl)-1,1'-biphenyl-4,4'-diamine.

The resulting mixture was dissolved to give 15 percent by weight solid in methylene chloride. This solution was applied on the CGL by extrusion to form a coating which after drying in a forced air oven gave a dry CTL 29 micrometers thick comprising 50:50 weight ratio of diamine transport charge transport compound to FPC0170 bisphenol A polycarbonate binder. The imaging member web, at this point if unrestrained, would curl upwardly into a 1½-inch tube.

The strip, about 10 millimeters wide, of the adhesive layer (IFL) left uncoated by the charge generator layer, was coated with a ground strip layer during the co-extrusion process. The ground strip layer coating mixture was prepared by combining 23.81 grams of polycarbonate resin FPC 0170, having 7.87 percent by total weight solids and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (ACHESON Graphite dispersion RW22790, available from Acheson Colloids Company (Port Huron, Mich.)) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the CTL, to the electrophotographic imaging member web to form an electrically conductive ground strip layer having a dried thickness of about 19 micrometers.

The imaging member web containing all of the above layers was then passed through 125° C. a forced air oven to dry the co-extrusion coated ground strip and CTL simultaneously to give respective 19 micrometers and 29 micrometers in dried thicknesses. At this point, the imaging member, having all the dried coating layers, would spontaneously curl upwardly into a 1½-inch roll when unrestrained as the web was cooled down to room ambient of 25° C.

An anti-curl coating was prepared by combining 88.2 grams of FPC0170 bisphenol A polycarbonate resin, 7.12 grams VITEL PE-200 copolyester (available from Goodyear Tire and Rubber Company (Akron, Ohio)) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and CTL) of the electrophotographic imaging member web by extrusion-coating and dried to a maximum temperature of 125° C. in a forced air oven for 3 minutes to produce a dried anti-curl back layer having a thickness of 17 micrometers and flattening the imaging member web. The conventional prior art flexible imaging member thus obtained was used to serve as a control.

Disclosure Example

Disclosure Imaging Member Preparation

A flexible electrophotographic imaging member web was prepared by following the very exact same procedures and material compositions as those described in the Control Example above, but with the exception that the aminopropyltriethoxy silane charge block layer was replaced with a 600 angstrom thick cross-linked melamine-formaldehyde undercoat layer formulated according to of the present disclosure. The formulation of the disclosed blocking layer was carried out as follows:

A pre-coating solution was first prepared to contain the following compositions:

| | |
|---|---|
| Binder: JONCRYL 587 | 8.44% wt |
| Cross-linking agent: CYMEL 303LF | 11.88% wt |
| Catalyst: NACURE XP357, 20% wt solid in solution | 1.80% wt |
| Solvent: DOWANOL | 77.88% wt |

It should be noted that CYMEL 303LF (from Cytec) is a methylolated melamine (a reaction product of melamine and formaldehyde) to serve as cross-linking agent; JONCRYL 587 (a hydroxyl functional acrylic polyol from BASF) is the binder resin; and catalyst NACURE XP357 (from King Industries) is an ionic salt of p-toluene sulfonic acid compounded with a liquid organic amine in methanol. The NACURE XP357, as received from King Industries, contains 20 weight percent solid p-toluene sulfonic acid/amine ionic salts in 80 weight percent methanol solvent. All these components were mixed and dissolved with agitation in DOWANOL (a propylene glycol monomethyl ether solvent also known as 1-methoxy-2-propanol, available form Dow Chemicals) to give the pre-coating solution. The concentration of this pre-coating solution (20.68% wt solid) as prepared was further adjusted by diluting it with DOWANOL to give a 0.5% wt solid final charge undercoat layer coating solution for application. The resulting solution as obtained was coated over a Ti/Zr/PEN substrate by hand coating procedure using a ¼ mil-gap bar and dried at 120° C. for one minute to give a 600 angstrom thick (measured with ellipsometer) dried cross-linked polyacrylate/melamine-formaldehyde undercoat layer. It was then followed up by subsequent coating layers of IFL/CGL, then CTL/ground strip layer co-coating, and finally an anticurl back coating to give the complete the imaging member web of this disclosure. If desire, the resulting imaging member may be added onto with a conventional protective overcoating layer of the prior art.

Physical/Mechanical and Photo-Electrical Evaluations

Both the Disclosure and the Control imaging members as prepared were evaluated for photo-electrical integrity using the lab. scanner. The 4000 scanner data, obtained under constant current voltage, listed in Table 1 below, show that the disclosure imaging member comprising the 600 angstrom thick innovative cross-linked polyacrylate/melamine-formaldehyde undercoat layer was effective to provide good charge blocking capability equivalent to that of the control imaging member having a standard silane blocking layer counterpart. In addition, the coated cross-linked polyacrylate/melamine-formaldehyde undercoat layer was also found to have good adhesion bonding to both the conductive Ti/Zr layer and the CGL as well.

TABLE 1

| Blocking Layer Identification | Vo (V) | S (V/ergs/cm$^2$) | Vc (V) | Vr (V) | Vdepl (V) | A (V/sec) |
|---|---|---|---|---|---|---|
| Standard Control | 800 | 402 | 160 | 39.0 | 86.9 | −230.5 |
| Disclosure | 800 | 475 | 157 | 35.3 | 83.3 | −244.1 |
| After 10K Cycles | | | | | | |

TABLE 1-continued

| Blocking Layer Identification | Vo (V) | S (V/ergs/cm$^2$) | Vc (V) | Vr (V) | Vdepl (V) | A (V/sec) |
|---|---|---|---|---|---|---|
| Standard Control | 800 | 394 | 208 | 59.5 | 252.1 | −236.0 |
| Disclosure | 800 | 460 | 202 | 50.4 | 144.8 | −241.7 |

Reference Example

Reference Imaging Member Preparation

To assess the implication of utilizing a thick melamine-formaldehyde blocking layer on the crucially important photoelectrical function, another imaging member was also prepared by following the very exact same procedures and material compositions as those described in the Disclosure Example above, except that the 600 angstrom thick cross-linked polyacrylate/melamine-formaldehyde undercoat layer was now prepared to have 2 micrometers in thickness. When assessed for its photoelectrical properties, using the same lab scanner and identical measurement procedures, this imaging member was unable to be discharged. The photoelectrical testing results thus obtained had indicated that the application of a thick cross-linked polyacrylate/melamine-formaldehyde undercoat layer in the prepared imaging member was too electrically insulative to be acceptable for practical application. This was an important finding as it was an indication suggesting that the melamine formaldehyde blocking layer should be prepared to have a thickness limit, for example in specific embodiments, not to exceed 2,000 angstroms in thickness.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A negatively charged electrophotographic imaging member, comprising:

a substrate comprising a conductive layer;

a charge blocking undercoat layer disposed on the conductive layer bearing substrate, wherein the charge blocking undercoat layer is formed from a coating solution further comprising a binder, a cross-linking melamine-formaldehyde, a catalyst, and a solvent; and at least one imaging layer formed on the charge blocking undercoat layer;

wherein the cross-linking melamine-formaldehyde charge blocking undercoat layer is formed from the reaction between melamine and formaldehyde to give methylolated melamine having the formula

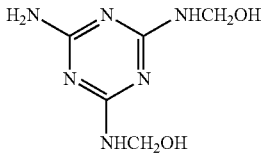

and subsequently reacting among themselves by a condensation reaction.

2. The electrophotographic imaging member of claim 1, wherein the condensation reaction is carried out at an elevated temperature of from about 120° C. to about 130° C. or by activation of a catalyst, and wherein the condensation reaction is represented by the following:

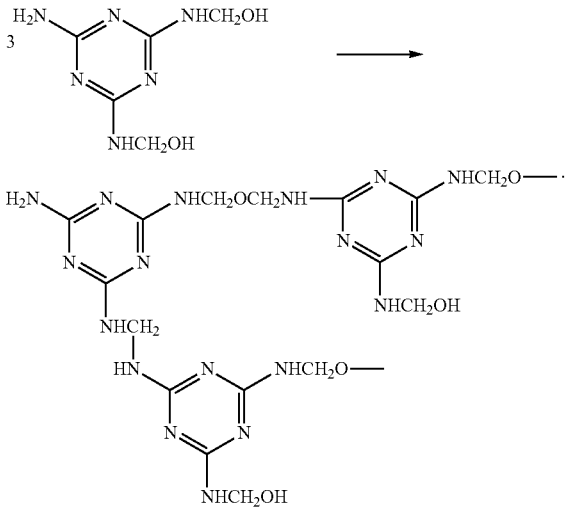

3. The electrophotographic imaging member of claim 2, wherein the mole ratio of melamine to formaldehyde in the cross-linking melamine-formaldehyde charge blocking undercoat layer is from about 1:2 to about 1:6.

4. The electrophotographic imaging member of claim 1, wherein the melamine-formaldehyde charge blocking undercoat layer is a triple composition layer formed from cross-linking between a polyhydroxyalkyl acrylate binder and a methylolated melamine cross-linker through a condensation reaction at an elevated temperature.

5. The electrophotographic imaging member of claim 4, wherein the polyhydroxyalkyl acrylate binder is selected from the group consisting of polyhydroxymethyl acrylate, polyhydroxyethyl acrylate, polyhydroxyproyl acrylate, polyhydroxybutyl acrylate, polyhydroxypentyl acrylate, polyhydroxyhexyl acrylate, and mixtures thereof.

6. The electrophotographic imaging member of claim 1, wherein the cross-linking melamine-formaldehyde charge blocking undercoat layer has a thickness of from about 50 to about 2,000 angstroms.

7. The electrophotographic imaging member of claim 6, wherein the cross-linking melamine-formaldehyde charge blocking undercoat layer has a thickness of from about 100 to about 1,500 angstroms.

8. The electrophotographic imaging member of claim 7, wherein the cross-linking melamine-formaldehyde charge blocking undercoat layer has a thickness of from about 200 to about 1,000 angstroms.

9. The electrophotographic imaging member of claim 1, wherein the catalyst is selected from the group consisting of dibutyltin dilaurate, zinc octoate, p-toluene sulfonic acid, and mixtures thereof.

10. The electrophotographic imaging member of claim 1, wherein the solvent is selected from the group consisting of alcohol, 1-methoxy-2-propanol, methyl n-amy ketone, methyl ethyl ketone, n-butyl acetate, xylene, toluene, glycol ether acetates, and mixtures thereof.

11. The electrophotographic imaging member of claim 10, wherein the weight ratio of solid present in the cross-linking melamine-formaldehyde charge blocking undercoat layer to the solvent solution is present in a weight ratio of from about 0.2:100 to about 2:100.

12. The electrophotographic imaging member of claim 1 having a charge acceptance ($V_0$) in a range of from about 750 to about 850 volts under a constant current voltage of 800 volts.

13. The electrophotographic imaging member of claim 1 having sensitivity (S) of from about 250 to about 450 volts/ergs/cm$^2$ under a constant current voltage of 800 volts.

14. The electrophotographic imaging member of claim 1 having a residual potential ($V_r$) less than about 100 volts under a constant current voltage of 800 volts.

15. The electrophotographic imaging member of claim 1 having a depletion potential (Vdepl) of less than about 200 volts under a constant current voltage of 800 volts.

16. The electrophotographic imaging member of claim 1 having a dark decay per second after charging (A) of less than about 300 volts.

17. A negatively charged electrophotographic imaging member, comprising:

a substrate;

a charge blocking undercoat layer disposed on the substrate, wherein the charge blocking undercoat layer is cross-linked and formed from a coating solution comprising a methylolated melamine having the formula

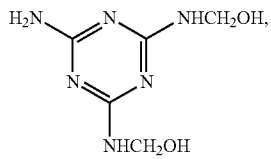

a formaldehyde, a catalyst, and a solvent; and at least one imaging layer formed on the cross-linked charge blocking undercoat layer, wherein the charge blocking undercoat layer is a three dimensional cross-linked network of melamine-formaldehyde formed by the following reactions:

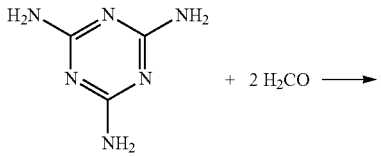

-continued

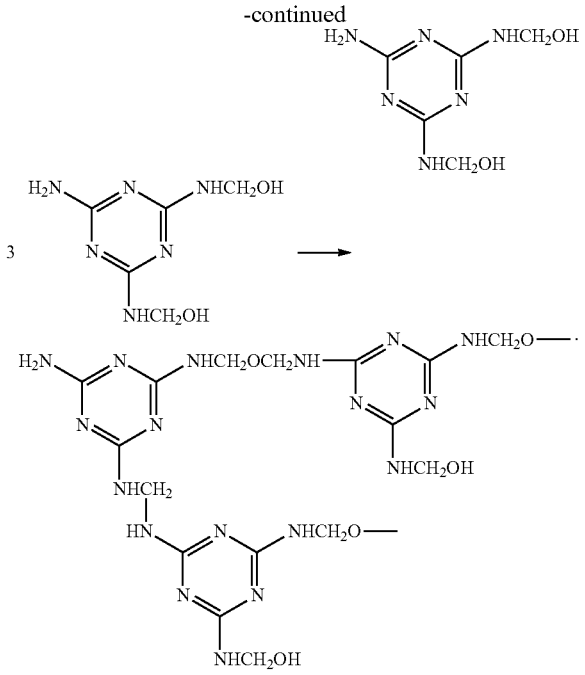

18. A negatively charged electrophotographic imaging member, comprising:

a substrate;

a charge blocking undercoat layer disposed on the substrate, wherein the charge blocking undercoat layer is formed from a coating solution further comprising a hydroxyl functional acrylic polyol binder, a methylolated melamine having the formula

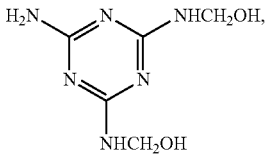

a catalyst, and a solvent; and at least one imaging layer formed on the charge blocking undercoat layer, wherein the charge blocking undercoat layer is a three dimensional cross-linked network formed from the reaction between the methylolated melamine and the hydroxyl functional acrylic polymer binder to obtain a cross-linked polyacrylate/melamine-formaldehyde charge blocking undercoat layer.

19. An image forming apparatus for forming images on a recording medium comprising:

a) a negatively charged electrophotographic imaging member having a charge retentive-surface to receive an electrostatic latent image thereon, wherein the electrophotographic imaging member comprises:

a flexible substrate, a cross-linked charge blocking undercoat layer disposed on the substrate, wherein the cross-linked charge blocking undercoat layer is formed from a coating solution comprising a methylolated melamine having the formula

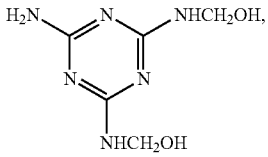

a catalyst, and a solvent, and at least one imaging layer formed on the cross-linked charge blocking undercoat layer;

b) a development component adjacent to the charge-retentive surface for applying a developer material to the charge-retentive surface to develop the electrostatic latent image to form a developed image on the charge-retentive surface;

c) a transfer component adjacent to the charge-retentive surface for transferring the developed image from the charge-retentive surface to a copy substrate; and d) a fusing component adjacent to the copy substrate for fusing the developed image to the copy substrate.

20. The image forming apparatus of claim 19, wherein the charge blocking undercoat layer further comprises a hydroxyl functional acrylic polyol binder that is used to react with the methylolated melamine to form a cross-linked polyacrylate/melamine-formaldehyde charge blocking undercoat layer.

* * * * *